United States Patent [19]

Claycomb

[11] 4,184,545

[45] Jan. 22, 1980

[54] MEASURING AND TRANSMITTING APPARATUS FOR USE IN A DRILL STRING

[76] Inventor: Jack R. Claycomb, 8226 Waynemen, Houston, Tex. 77040

[21] Appl. No.: 890,368

[22] Filed: Mar. 27, 1978

[51] Int. Cl.[2] ..... E21B 47/022

[52] U.S. Cl. ..... 166/113; 166/250; 175/45; 175/48; 175/50; 33/307; 367/85

[58] Field of Search ..... 166/113, 250, 254, 255; 175/45, 48, 50; 33/307; 73/151; 116/137 R; 340/18 LD

[56] References Cited

U.S. PATENT DOCUMENTS

| | | | |
|---|---|---|---|
| 2,787,759 | 4/1957 | Arps | 175/50 X |
| 2,978,634 | 4/1961 | Arps | 175/50 X |
| 3,408,561 | 10/1968 | Redwine et al. | 324/6 |
| 3,711,825 | 1/1973 | Claycomb | 340/18 LD |
| 3,713,089 | 1/1973 | Claycomb | 340/18 LD |
| 3,964,556 | 6/1976 | Gearhart et al. | 175/45 |
| 4,120,097 | 10/1978 | Jeter | 33/307 |

*Primary Examiner*—Ernest R. Purser
*Assistant Examiner*—Nick A. Nichols, Jr.
*Attorney, Agent, or Firm*—Donald Gunn

[57] ABSTRACT

Measuring and transmitting apparatus is the subject matter of the preferred embodiment which comprises an elongate tubular member functioning as a drill collar and adapted to be placed in a drill string. The apparatus utilizes a mud driven motor, while the mud flows therethrough functioning as a drill collar and out the bottom. The motor creates electric power which is used to operate selected transducers. The transducers form measurements which are encoded. The encoding portion of the equipment utilizes an oil reservoir, a mud driven pump, a valve which dumps the oil back to the reservoir if there is no signal and which otherwise delivers it to a two-position, four-way spool valve which drives a modulated signal generator. The signal generator modulates the back pressure in the mud flow by restricting the mud flow, thereby forming a signal which is sensed in the mud flow path.

17 Claims, 10 Drawing Figures

MEASURING AND TRANSMITTING APPARATUS FOR USE IN A DRILL STRING

BACKGROUND OF THE DISCLOSURE

There are numerous measuring while drilling tools. The present invention is believed to be an improvement over them in that it provides a significantly self-contained device which forms the output signals modulated into the mud flow. Every well that is drilled must have a mud flow system whereby mud is pumped down the drill string and returns in the annulus on the outside of the drill string. The present invention modulates this mud flow. The apparatus is self-contained in that it generates its own electric power for operation of transducers, and the signals are imposed on a two-position, four-way valve. This valve is switched open and shut, switching between the two positions and thereby forms an output signal.

DETAILED DESCRIPTION OF THE ILLUSTRATED EMBODIMENT

Figure 1:
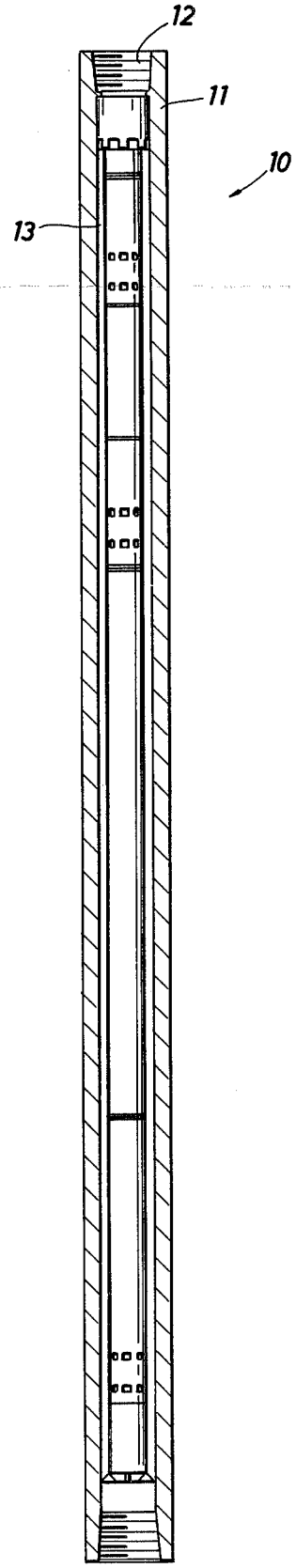
FIG. 1 is a sectional view through the outer wall of the present invention which is coupled in a drill string just above the drill bit among the drill collars.

Attention is first directed to FIG. 1 of the drawings. There, the numeral 10 identifies a measuring device as taught by this invention. It functions as a drill collar. It is formed with an external heavy wall body 11 having an upper end 12 constructed in accordance with API requirements to permit its connected in a drill string. An annulus is defined at 13, and the mud flows through the annulus 13. There is a central member extending the length of the tool 10 where the operative equipment is found. The annulus 13 has a total cross section which enables it to deliver the mud in suitable volume without constricting it unduly. There are constrictions as will be described, but they are controlled constrictions, and the annular space 13 is sufficiently large to avoid blocking the mud flow.

Attention is next directed to FIG. 3A, where the tool will be described proceeding from the top to the bottom. The heavy duty outer wall 11 extends the full length of the tool. Typically, it is made of monel or other nonmagnetic metals to avoid interference with a compass which is normally included in the instrument package.

In the upper end of the tool 10, a sleeve 15 is snugly fitting in the interior of the outer wall 11. It fits snugly in the tool. It is internally threaded at the upper end and receives a hollow fitting 16. The fitting 16 is hollow and supports a funnel shaped opening member 17. The member 17 is funnel shaped at the very top end as shown in FIG. 3A. It is joined at a set of threads 18 to the hollow tubular fitting 16. All of the mud which flows through the tool must flow through the axial passage 19 through the apparatus 17. All of the mud is directed downwardly through this passage 19. It will be observed that the hollow, funnel shaped, tubular member 17 terminates at a shoulder member 20. The shoulder member is immediately adjacent to but does not touch a matching shoulder 21. The matching shoulder 21 is free to rotate. The shoulder 21 is in the form of a circular piece of stock which has a rectangular cross section and which is supported on the upper end of a flared fairing 22. The fairing 22 enlarges at its lower end. It flares to a larger diameter where it threads to a support plate 23. The support plate 23 has a bottom located, central mounting shaft 24. The shaft 24 is for the purpose of centering the support plate 23 and enables its rotation.

Figure 3A:
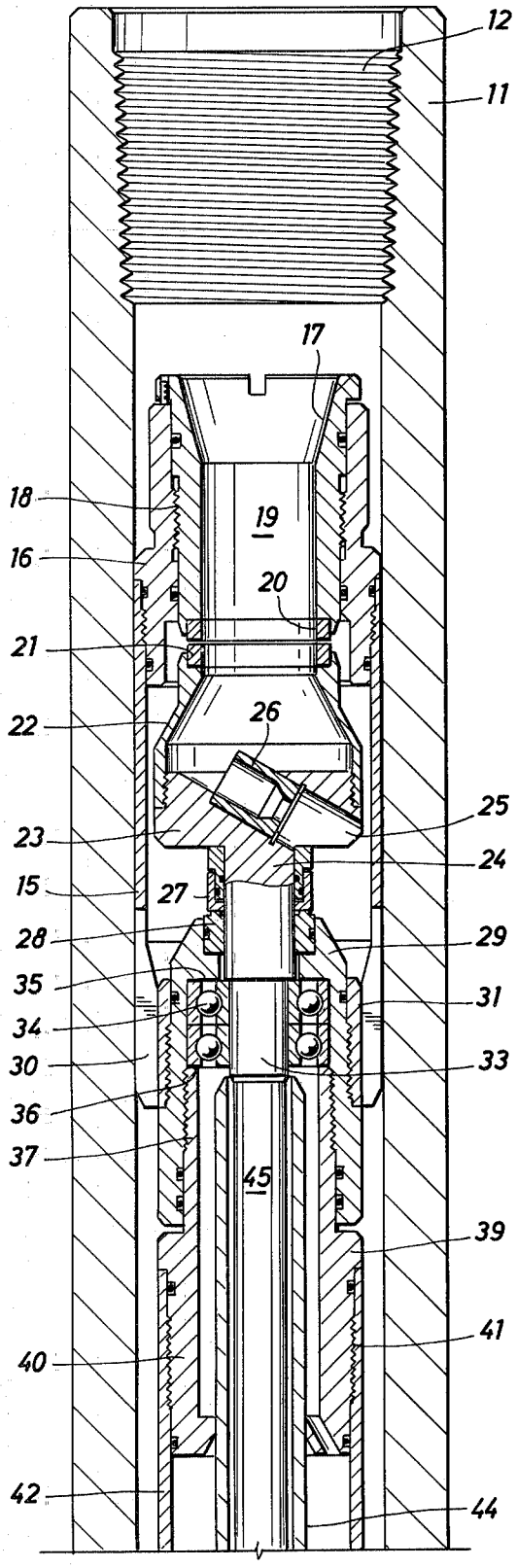
FIG. 3, which comprises portions 3A through 3H, inclusive, is a detailed structural drawing of the preferred embodiment.

The drawing of FIG. 3A shows a single, angled passage 25 drilled in the plate. The passage 25 is fitted with a removable nozzle 26. The passage is located towards the edge of the plate 23. It extends at an angle of the sort shown in FIG. 3A. Preferably, two or even three similar passages are included. A top view of the plate 23 thus shows three oval shaped openings arranged around the circumference of the plate 23, and they all pass through the plate at angled directions. The plate 23 supports the several passages to collectively function as a turbine. As the mud flows through the funnel shaped opening member 17, the reactive force of the mud flow at the nozzle 26 creates a rotative force. The plate 23 rotates and carries with it the hollow fairing 22 and the top shoulder 21 mounted thereon. It will be understood that both sides of the fairing 22 are surrounded by mud. There is no constraint on mud encircling the back side of the fairing. However, the dynamic movement of mud through the passages 25 results in rotation of the plate 23, which, in turn, is imparted to the mounting shaft 24.

A mud seal 27 is located on the shaft 24. A seal ring 28 is just below it. The seal ring 28 is supported in a fixed, tubular housing 29. The housing 29 is centered in the heavy duty drill collar body 11. The housing 29 is tapered at its upper end to direct or divert the mud flow to the exterior. The sleeve 15 which is on the interior of the drill collar body 11 supports two, three or four alignment fins 30. The fins 30 support an internally threaded spool 31 which threads to the hollow housing 29. This anchors the housing 29 in location as shown in FIG. 3A.

The housing 29 is stationary. The rotating shaft 24 extends down into it. The shaft 24 reduces in diameter at 33 where it is supported in a suitable ball bearing assembly 34. The ball bearing assembly is caught between an upper shoulder 35 and a lower shoulder 36. The shoulder 36 is defined by the upper terminus of a sleeve 37 threaded into the housing 29 on the interior. When the tool unthreads (as by removal of the threaded spool 31), this permits the ball bearing assembly 34 to slide up against the soulder 35 for ease of assembly. Moreover, the shaft at 33 is provided with the shoulders 35 and 36 described above to support the shaft 33 on the ball bearing assembly.

As noted above, the tubular housing 29 is anchored. It receives the upstanding step shaped skirt 37 affixed to the top end of a second tubular member 39. The tubular member 39 has an external diameter approximately equal to the external diameter of the short spool 31 threaded to the tubular housing 29. The three tubular components assemble in telescoped fashion. One telescopes within the other, and they thread together. The tubular member 39 thus has the appended upper tubular skirt 37 and a lower body 40 which is externally threaded at 41 for the purpose of receiving a relatively long, hollow, cylindrical housing 42 having the form of a thin tubing. The housing 42 is threaded and sealed as illustrated.

All of these components in the lower part of FIG. 3A are stationary. On the interior, they receive and support a fixed sleeve 44 formed of a thin tubing. The housing 44 encloses the shaft portion 45. The shaft portion 45 is a further extension of the shaft 24, it being located in the sleeve 44 with a small clearance. The entire interior space of the sleeve 44 is filled with lubricating oil. The lubricating system is not pumped, but it is pressurized. It is fully pressurized by incorporating a seal ring 43 at the top of FIG. 3B. The seal ring is on the exterior of the housing 44. A void cavity 46 is defined thereabove and is adapted to be filled with lubricating oil. The seal ring 43 is thus exposed to lubricating oil above it and is exposed to drilling mud therebelow. The external housing 42 has an access window at 47. The window permits mud to flow to the interior of the housing 42.

Figure 3B:
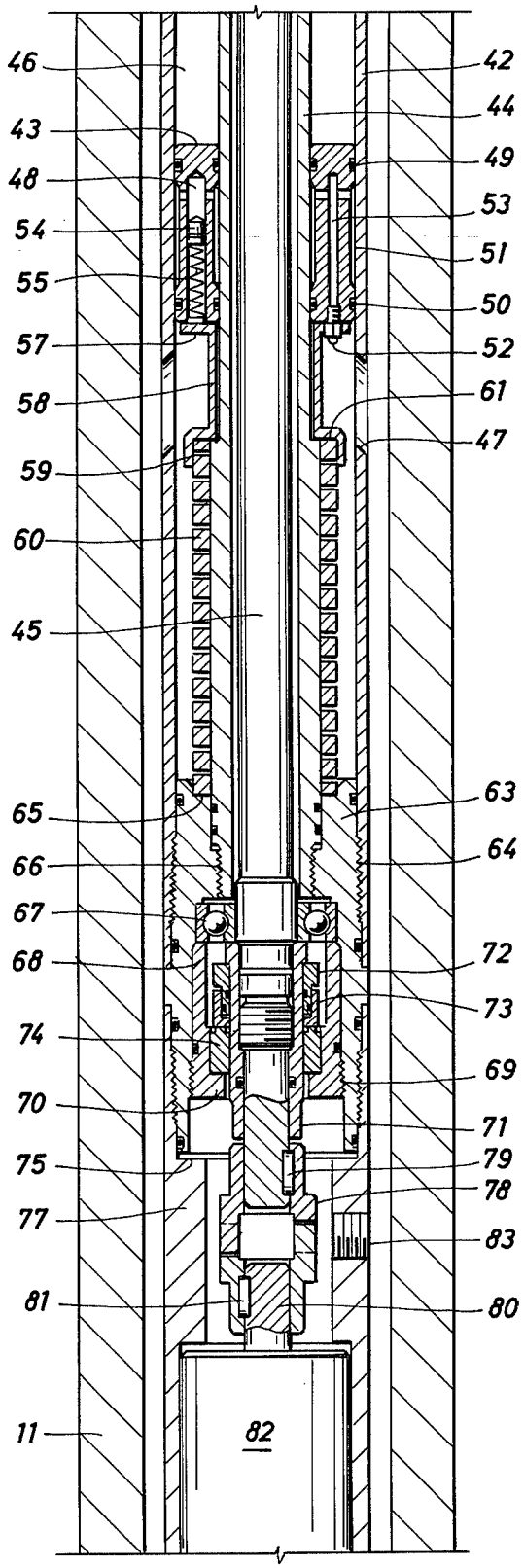

The seal ring 43 of FIG. 3B is pressurized. It includes a reservoir 48 for heavy packing grease. The reservoir is in the form of an internal, hollow passage which encircles the seal ring 43. The seal ring is equipped with a seal 49 at the upper end and a similar seal 50 at the lower end. Between the two, a surface of reduced diameter 51 is incorporated. An alemite fitting 52 communicates through a passage 53 to the chamber 48 to fill it with packing grease. The grease is pressurized by a plug 54. The plug 54 is urged against the grease by a coil spring 55. When packing grease is placed in the reservior 48 under pressure, the spring 55 is compressed. The grease is forced out of the chamber or reservior 48 into contact with the surfaces against which the seal is perfected. The grease helps pack and isolate the seal ring 43. To the extent that any grease is lost, the coil spring 55 maintains a constant pressure on the lubrication system so that an effective seal is maintained as long as there is pressure. It will be observed that the seal ring 43 seals both on its inner face and its outer concentric face, the faces contacting the hollow outer housing 43 and the inner housing 44.

The seal ring is prevented from moving downwardly in FIG. 3B by an outwardly directed shoulders 57 on a bushing 58. The bushing 58 is flared at 59 to receive and seat a stacked coil spring 60. The coil spring forces the seal assembly upwardly. The bushing 58 cannot travel downwardly because the tubular housing 44 is equipped with a shoulder 61. The shoulder 61 limits movement of the bushing 58.

The coil spring 60 is compressed when installed. It provides an upward force which additionally controllably pressurizes the oil in the chamber 46 and thereby pressurizes the lubricating oil in the upper portions of the tool 10.

The coil spring 60 is centered around the inner elongate tubular housing 44 which itself encompasses and encloses the rotatable shaft 45. The external elongate tubular housing 42 which is concentric thereabout extends downwardly to a threaded fitting 63 shown in FIG. 3B. The fitting 63 is threaded at 64 to the interior of the hollow outer housing 42. It has an upwardly facing shoulder 65 for supporting the coil spring 60. The internal tubular housing 44 is additionally threaded to the tubular member 63 by a threaded connection 66. The connection 66 holds the two tubular housings concentric of one another.

The rotating shaft 45 is aligned by a bearing assembly 67 which is pressed upwardly against a shoulder in the threaded fitting 63. The bearing assembly is held in place by a hollow, threaded nut 68, the nut having threads on its exterior tubular surface for threaded connection at 69. The threaded nut 68 includes an internally directly lower shoulder 70 which captures and holds a seal assembly. It will be recalled that the shaft 45 rotates. A sleeve 71 is fitted around the shaft to rotate with it. The sleeve 71 rests against the inner race of the bearing assembly 67. The sleeve 71 rotates with the shaft 45 and is threaded to it. It supports a rotating seal member 72. It, in turn, supports a coacting or fitted seal member 73, and the two are pressed together by a seal ring 74 supported above the shoulder 70. The seal ring 74 and the two seal members 72 and 73 define the bottom limit on the flow of lubricating oil from the chamber 46. The lubricating oil flows along the shaft 45 to lubricate the bearing assembly 67. It also flows down to the seal ring 74 but cannot proceed any further. The seal ring 74 has clearance around the shaft so as to minimize friction with the rotating sleeve 71 threaded to the shaft. The lubricating oil for the shaft 45 thus can flow down only to the top side of the seal ring 74.

It will be recalled that the bearing assembly described above is captured in the elongate tubular fitting 63. The fitting 63 terminates adjacent to a shoulder 75 in a tubular extension 77. Extension 77 has an external diameter equal to the diameter of the outer tubular housing 42 and extends therebelow to function as a housing. It joins to the fitting 63 which functions somewhat as a coupling.

The shaft 45 terminates at a coupling 78 and is joined to it by means of a key in a key slot. The key is identified by the numeral 79. The coupling 78 is thus fitted around the bottom end of the shaft. The coupling 78 is equipped with a lower coupling means for connection to an additional shaft. The shaft is identified by the numeral 80, and the coupling 78 is joined to it by means of a key 81 in a key slot. The shaft 45 thus rotates the shaft 80. The shaft 80 extends into an alternator 82 which is a purchased unit having the shaft protruding therefrom and which is snugly fitted inside the elongate tubular housing member 77. The interior of the tool shown in FIG. 3B is filled with lubricating oil through a plug opening and inspection port 83. The lubricant surrounds the coupling assembly 78.

Figure 3C:
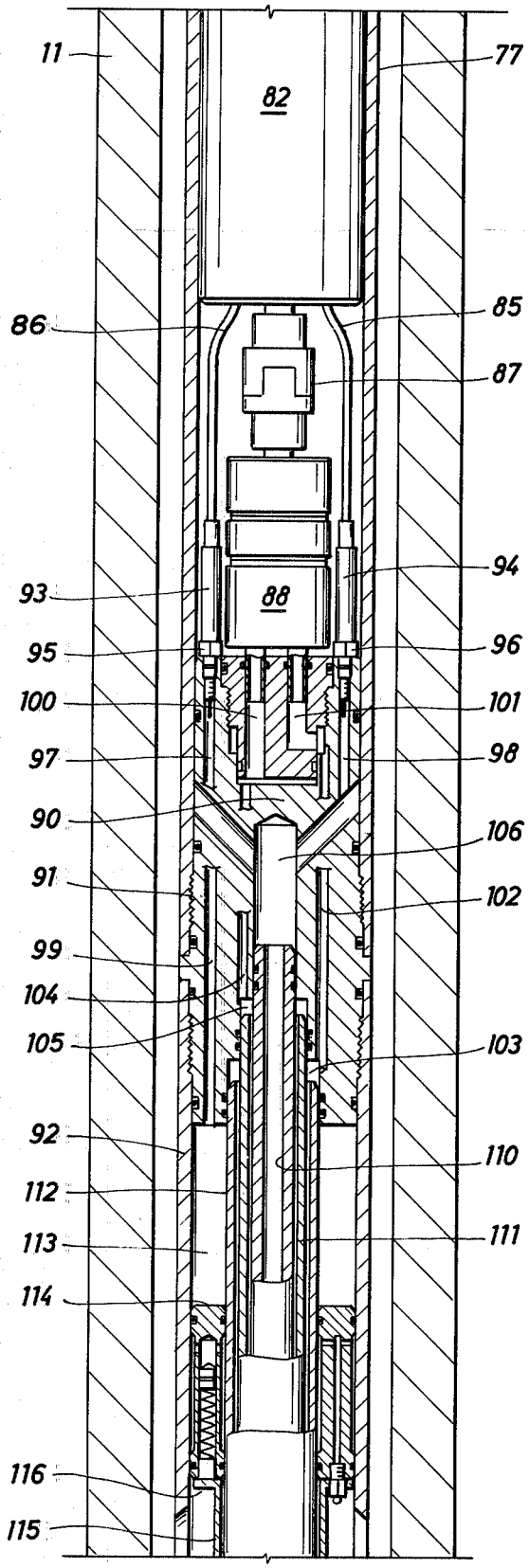

Attention is next directed to FIG. 3C of the drawings. The alternator 82 is shown in FIG. 3C at the upper end. It forms an electrical power output carried over two conductors, one being identified by the numeral 85 and the other bearing the numeral 86. The alternator 82 is equipped with a shaft extending through the full length of it, the shaft extending from the lower end and engaging a coupling 87. The coupling 87 engages the drive shaft of a gear pump 88. It is a closed or self-contained assembly. It is axially aligned with and located just below the alternator 82.

The pump 88 is supported on a solid plug body 90 as shown in FIG. 3C. The body 90 is threaded at 91 to the tubular housing 77. It serves as an extension or continuation for a similar tubular housing 92 which has the same external diameter as the tubular housing 77. The plug 90 is a support structure. First of all, it is a support structure which provides mechanical support for the gear pump 88. The gear pump 88 is joined to it by suitable tubular members to be described which are rigidly fixed in the plug body 90. In addition, the electrical conductors 85 and 86 connect through suitable insulative posts 93 and 94 into sealed passages. It will be observed that FIG. 3C depicts the conductors 85 and 86 extending to the posts 93 and 94. They, in turn, connect with threaded, sealed fittings 95 and 96 which then communicate with axial passages for receiving the electrical conductors. The sealed fittings 95 and 96 are connected with suitable axial passages 97 and 98. The electrical connectors pass through the plug 90, and they extend therebelow in a single passage.

The numeral 99 identifies a lubricating oil passage. It passes all the way through the plug 90. Again, for sake of clarity in the drawings, it has been interrupted, but it does extend from the bottom to the top end of the plug 90 to thereby lubricate the chamber surrounding the gear pump 88, the coupling 87 and the apparatus above the plug 90. Indeed, the alternator 82 does not have to completely plug the housing so that it is permissible for lubricating oil to flow on the exterior of the alternator housing to the cavity thereabove. It will be recalled that the plug 83 just above the alternator 82 in FIG. 3B was incorporated for the purpose of adding lubricating oil. A bath of lubricating oil flows through the alternator to lubricate and cool its bearings. A unified lubricating system is preferable, in fact, and, to this end, the alternator 82 permits flow through to all areas of the tool.

The pump 88 has a low pressure inlet side and a high pressure outlet side. In theory, it does not matter which path or line is high pressure and which is low pressure. The pump 88 is equipped with gears which drive the hydraulic oil which is supplied to it. The high pressure or outlet side is identified by the numeral 100, while the low pressure side is at 101. The low pressure conduit is through a passage 102 which extends downwardly to an encircling internal groove 103. The groove 103 is internal of the plug 90 and flows the low pressure oil through the passage 102. By contrast, the high pressure or outlet side 100 extends through a passage 104 which terminates at an internal groove 105 in the plug.

The plug 109 is counterbored from its bottom end to define three separate bores as shown in FIG. 3C. The smallest diameter is in the passage 106. The passage 106 is centrally located and adapted to receive the two conductors which are directed through the passages 97 and 98 into the angled passages and then into the central axial passage 106. The two conductors form a cable pair, and they are positioned on the interior of a centeral conduit 110. The conduit 110 is the smallest of three concentric conduits. The next larger conduit is 111, and it extends upwardly into the plug 90 and stops just short of the concentric annular groove or cavity 105. This enables the conduit 111 to connect with the high pressure line 104. The line 104 thus delivers oil which flows in a concentric passage around the tubular member 110 and within the conduit 111. The third larger conduit is 112 which is on the exterior and which defines an internal annular space in communication with the annular cavity 103. Thus, the high pressure flow is on the interior of the low pressure flow. The high pressure flow is downward in the tool 10, and the low pressure flow is upward in the tool to the pump 88.

The numeral 113 in FIG. 3C identifies a void space where lubricating oil is stored and received. It will be recalled that it feeds up through the passage 99 to points above the plug 90. It is pressurized by a ring seal assembly 114. This is similar in construction to the seal assembly shown at 43 in FIG. 3B. It is believed that its similar mode of operation avoids the necessity of a lengthy explanation.

The seal assembly 114 is supported on a loose fitting bracket 115 which carries a protruding shoulder 116 at its upper end which presses against the seal 114. The tubular bracket 115 flares outwardly at 117 at the top of FIG. 3D and is abutted against the turns of a stacked coil spring 118. The coil spring fits about the tubular conduit 112. It will be observed in FIG. 3C that the cylindrical housing 92 has a window or port formed in it to permit access to the alemite fitting on the seal assembly 114. There are no moving parts on the exterior exposed to mud at this location.

Figure 3D:
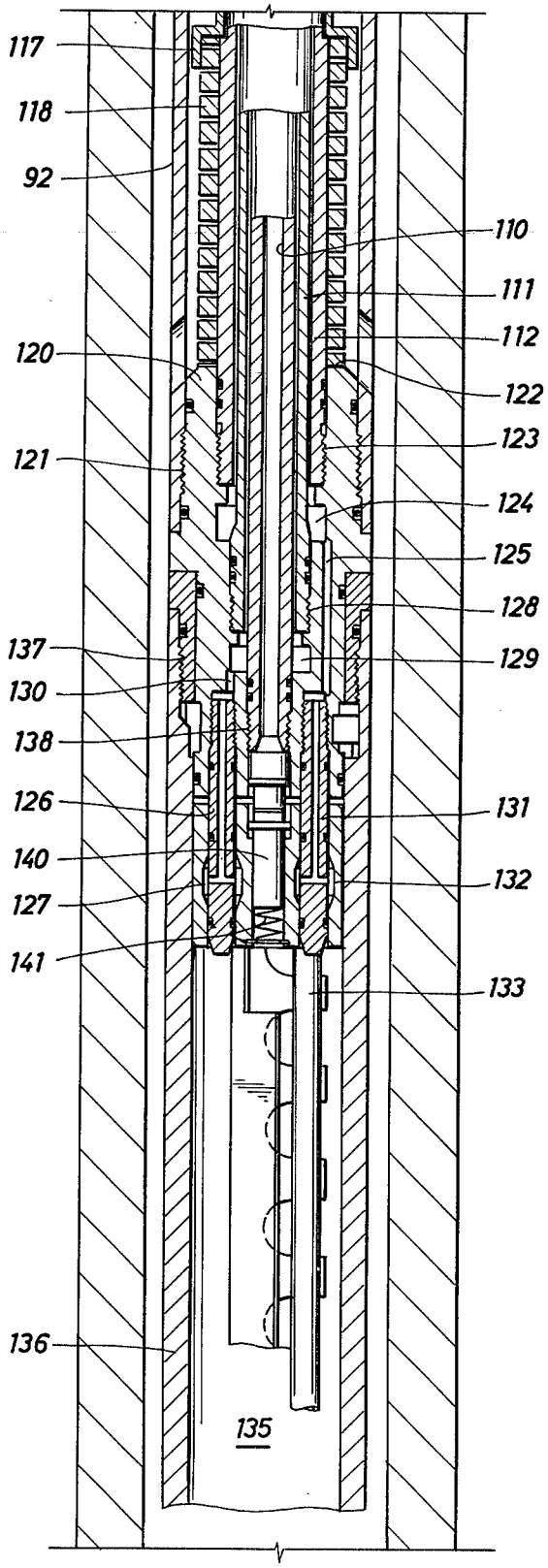

As shown in FIG. 3D, the outside tubular housing 92 extends to a connective plug 120. The two are threaded together at 121 with suitable O-ring seals above and below the threaded connection. The plug 120 is equipped with an upwardly facing shoulder 122 for supporting the spring 118. The shoulder 122 is concentric on the inside of the threaded connection 121. On the interior of the shoulder 122, a concentric, internally threaded connection 123 is incorporated for connection to the concentric tubular conduit 112. The tubular conduit 112 terminates at the threaded connection 123. The low pressure supply flows upwardly on the interior of the tubular member 112. This supply is introduced to the tubular conduit 112 through an annular ring-like cavity 124 which, in turn, is fed from a passage 125 in the plug body 120. The passage 125 is an extension for a small diameter, threaded insert 131 received into the plug body 120. The threaded insert 131, in turn, is connected with an adjacent tube 133 opening into a ring-like cavity 132 to make the crossover between the tube 133 and the threaded insert 131. The tube 133 extends past certain electronic equipment as will be described.

The numeral 111 identifies a centralized conduit within the tubular conduit 112. The tubular conduit 111 terminates at a threaded connection 128 which is immediately above an annular ring-like cavity 129. Flow on the interior of the tubular conduit 111 is delivered to the annular cavity 129. In turn, it then flows through a small passage 130 formed in the plug 120 and is communicated from there into a threaded insert 126 which is similar to the threaded insert 131. The threaded insert 126 is sealed into the plug body 120. It is axially hollow. It communicates with an annular cavity 127 to enable crossover from threaded insert 126 to a tubular member. The tubular member extends downwardly past the electronic package to be described. Two tubes extend down through the lower portions of FIG. 3D, one being omitted for sake of clarity.

The numeral 135 identifies a hermetically sealed package of electronic equipment placed on the interior of a tubular member 136. The tubular member 136 is threaded at 137 to the bottom side of the plug 120 and serves as an extension for the tubular housing 92. Preferably, it has the same external diameter. The electronic package 135 is not round. It fills substantially all the cross sectional area of the round tubular member 136, except that sufficient clearance is left for the two tubular members which extend past it to carry the high pressure and low pressure hydraulic oil. The electronic package is provided with electrical power. To this end, the conduit 110, centrally located in the conduit 111, carries the electrical pair. The conduit 110 is threaded to the plug 120 just below the annular cavity 129 by a threaded connection 138. The tubular conduit 110 encases the conductor pair. The conductors terminate in bayonet plugs and are received into a socket 140 which socket is forced upwardly against the bayonet plug by a coil spring 141. Suitable wires extend from the socket 140 into the electronic package 135 to deliver the necessary power for operation of the electronic equipment.

The precise nature of the electronic equipment is not specifically given. Electronic equipment for downhole logging purposes is believed to be well known. There are many variables which can be encoded by electronically powered transducers, and it is housed in the package 135. The equipment in the package 135 forms output signals transmitted by two pairs of electrical conductors which extend below the electronic package 135. The electronic package 135 is thus shown at the top of FIG. 3E. The conductors carrying those signals emerge from the bottom, pass through a coil spring 144, a socket body 145, and a plug 146 connected into the socket body 145. The conductors extend downwardly through a hollow passage 147 formed in a support body 148 and emerge through a small opening 149 to extend therebelow. A two-position valve 150 momentarily unloads pressure above a certain level from the line 155 into the area around the valve 150.

The electronic package is supported by the support body 148. It is threaded to the outer tubular member 136. The support body 136 further includes an axial passage 151 which is axially communicated with a threaded connector 152 to form a path for high pressure hydraulic oil. The hydraulic oil is delivered via a tubing past the electronic package 135 into a fitting adjacent to the threaded connector 152, and the two are communicated together by means of an annular recess 153. The threaded connector 152 has ports opening into the cavity 153 to introduce the flow to the passage 151. The flow path further includes the passage 155 through the valve 150.

FIG. 3D shows the tubing 133 extending adjacent to the electronic equipment 135. The tubing 133 opens into an annular cavity 157 immediately adjacent to a threaded, tubular conduit 158. The threaded member 158 is axially hollow and includes radial passages so that a flow path is defined through it into a passage 160. The passage 160 is parallel to the passage 151. The two passages cooperatively provide the two paths for transfer of the oil under pressure. One is to the pump, and the other is the return from the pump. One passage is connected to the unloader valve 150; the high pressure line selectively dumped when there is no output signal.

At this juncture, it will be observed that the oil flow passage 151 is communicated through the passage 155, the valve 150 and the outlet passage 162. The passage 160 of the solid support body 148 opens into the interior of the tool. At this juncture, the tool utilizes another outer shell member 164 which threads to the solid support body 148. The member 164 has the same external diameter as the member 136. The two of them thread together at the solid body 148 to serve as a continuation of the tool 10. The passage 160 thus opens into a void chamber 165. The chamber 165 is still part of the oil flow path. The flow path continues from the open or void chamber 165 and further provides an external bath for the components in the interior of the tool. This is also a temperature stabilization technique to prevent development of hot spots in the equipment.

Figure 3E:
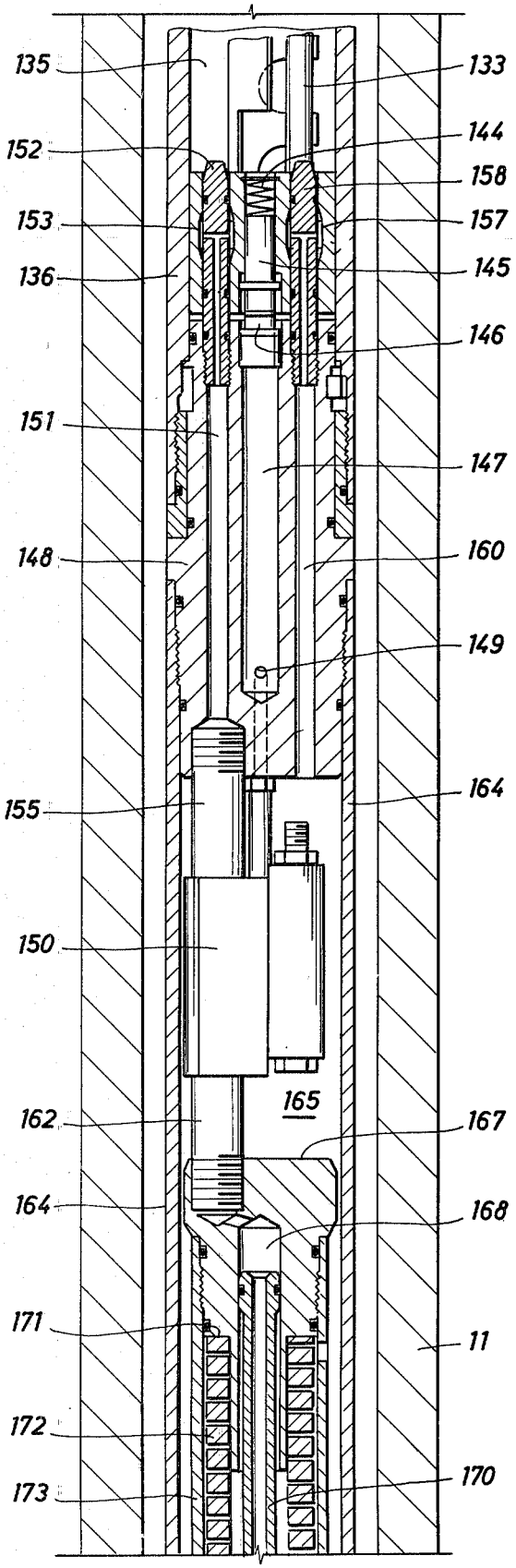

Continuing with the lower portions of FIG. 3E, the flow path 162 which is in the form of a pipe joined to the valve 150 threads into a larger fitting 167 which is axially hollow at 168. This is the internal flow path. The external flow path is from the void chamber 165 to the outside of the member 167. The member 167 is axially drilled at 168 to receive an inside tubular member 170 which is hollow to continue the centralized flow path. The tubular member 170 is able to slide into the drilled opening 168. The body 167 incorporates a downwardly facing shoulder 171 which is a seat for a coil spring 172. The spring 172 is on the exterior of the tubular member 170. It is on the interior of a concentric tubular member 173 which is threaded to the body 167. All of this is captured in the tubular member 164 which continues downwardly defining on its exterior a mud flow path adjacent to the drill collar body 11. The two flow paths at this juncture are simply defined as the central flow path through the tubular member 170 and the external flow path on the outside of the member 170 and on both sides of the tubular member 173.

Figure 3F:
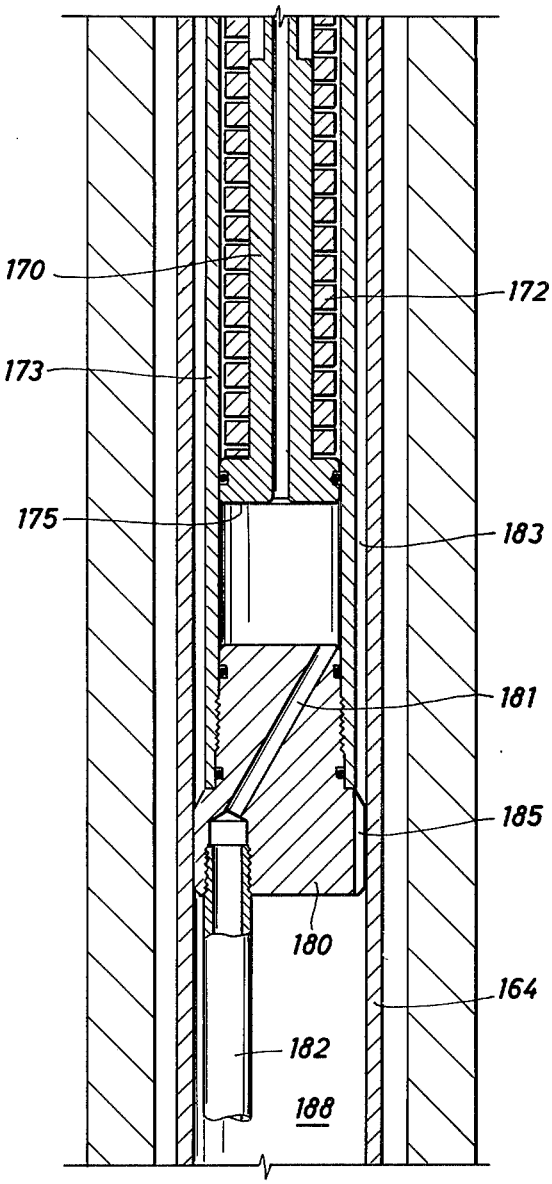

The apparatus shown at the lower portions of FIG. 3E continues in FIG. 3F. There, the internal tubular member 170 terminates at an enlargement 175 which is received on the interior of the tubular member 173. It is sufficiently large to support the coil spring 172. The spring 172 thus forces the enlargement 175 down away from the central, threaded body 167 at the top end of the spring. The tubular member 173 is threaded to a closure plug 180. The plug 180 continues the central flow path by incorporating a passage 181 from the top of the plug to the lower portions, and, there, a tubular member 182 continues the flow path. The external flow path is in the annular space 183. This is on the interior of the tubular member 164. The tubular member 164 surrounds the solid plug 181, and spacer ribs 185 position the plug 180 so that the external flow path extends past the plug 180. In the lower portions of FIG. 3F, the flow path is thus defined by the tubular member 182 and the remainder of the cavity. There is a void 188 which comprises a portion of this flow path.

Figure 3G:
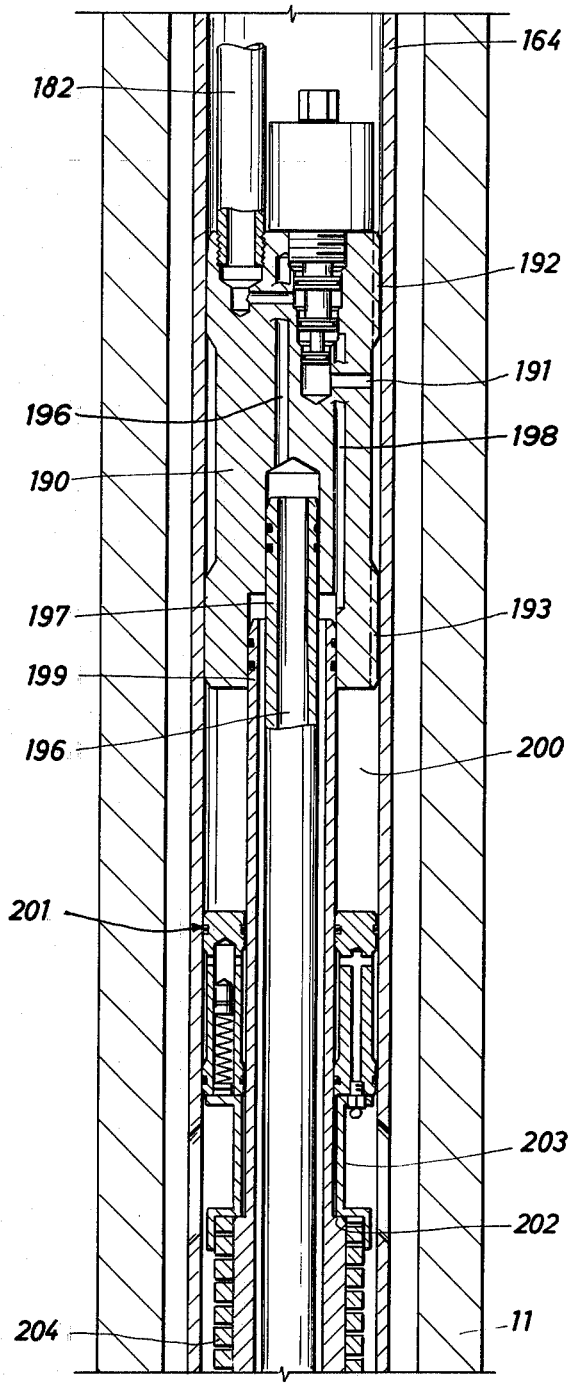

In FIG. 3G, the conduit 182 is input to a two-position, four-way valve. The valve 190 is provided with ne fluid input through the conduit 182 and a fluid exhaust through the port 191. The port 191 is in communication with the void space 188. The valve body is mounted on ribs 192 and 193 so that the external flow path extends past the valve body. The valve body is thus provided with the two fluid passages at 182 and 191. Flow is switched by a solenoid valve operator 195 which is connected to a pair of conductors previously described. They provide a signal to switch the valve between the two operative positions. The valve 90 has two outputs. One is through the passage 196, and the other is through the passage 198. High pressure can be selectively switched between the two. It will be observed that the valve outputs are in concentric conductors 197 and 199. The two electrical conductors are connected into the valve body by suitable seals which isolate them.

The valve operator 195 switches the flow of the high pressure hydraulic oil to the passages 196 or 198. One is the high pressure side, and the other is the low pressure side. The void space 200 is at the low pressure level, being in communication with the void space 188 (see FIG. 3F) and the low pressure port 191 of the valve 190. The void space 200 is closed off by a seal ring 201. The seal assembly at 201 is similar to the seal assemblies 43 shown in FIG. 3B and 114 shown in FIG. 3C. It seals between the tube 199 on the interior and the tubular member 164 on the exterior. Again, mud flows on the interior of the drill collar 11.

The seal assembly 201 pressurizes the hydraulic oil in the void 200 and, hence, defines the minimum pressure in the sump of the hydraulic system. The 201 is energized with packing grease supplied to it through the alemite fitting previously described. Moreover, the seal assembly 201 is held at a specific location by the shoulder 202 which supports the circular mounting bracket 203.

Figure 3H:
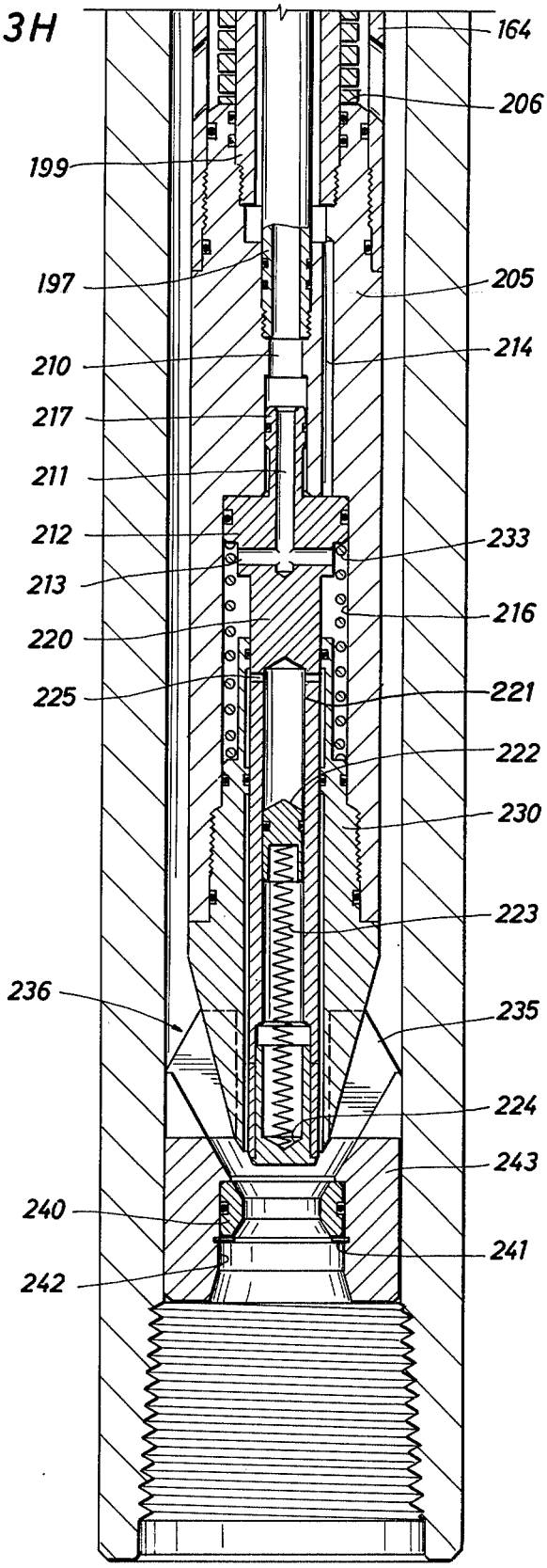

The bracket 203 cooperates with the coil spring 204 pressing upwardly against it. The coil spring is also shown in FIG. 3H resting on the bottom sub 205. The bottom sub is threaded to the outer tubular member 164 and incorporates a shoulder 206 for supporting the coil spring. The bottom sub is threaded to the outer tubular member 164. In addition, it is threaded to the concentric fluid conductors 197 and 199. It will be recalled that the conductors 197 and 199 carry the hydraulic oil for the operation of a bottom piston. Accordingly, the hydraulic oil conductor 197 opens into an internal passage 210 which, in turn, funnels through a passage 211 extending through a piston 212 received in the bottom sub 205. The passage 211 opens below the piston through a lateral port 213. The lateral port 213 introduces oil under pressure to drive the piston upwardly.

The outer fluid conductor 199 opens into a passage 214 which opens above the piston 212. The piston is received in a cylindrical bore 216. The cylindrical bore permits the piston to stroke a specified distance. It will be observed that the piston has an appendage at the top end identified by the numeral 217 which incorporates a seal on the exterior so that the passage 210 delivers oil under pressure past the piston but not to the top face thereof. The appendage at the top center portion of the piston is thus sealed and maintains a sliding seal in the passage 210 thereabove.

The piston 212 includes an elongate, bottom located extension, also. It is in the form of a tubular member 220 which is axially drilled and hollow at 221. The hollow portion is a receptacle for packing grease. The axial portion is plugged by a spring mounted plug 222 which is forced upwardly by a spring 223. The spring 223 is captured in the axial passage by a cap 224. The coil spring 223 maintains pressure on the plug 222 which, in turn, pressurizes packing grease in the axial chamber 221. The packing grease is permitted to lubricate the exterior of the piston extension 220 by flowing through a passage 225 which opens to the exterior between upper and lower O-ring seals. The seals are adjacent to a threaded insert 230 which is threaded into the bottom sub 205. As will be observed, the insert 230 incorporates a tubular, hollow, concentric skirt extending upwardly around the piston extension 220 and further includes a shoulder for receiving a coil spring 223. The coil spring 233 forces the piston 212 upwardly.

The bottom insert 230 includes vanes 235 which support and align centrally the bottom sub 205 and also which define ports or passages 236 where mud flows toward a central constriction 240. The constriction 240 is sized to adequately handle the mud volume. The constriction 240 is a narrow throat of reinforced, heavy duty, wear-resistant metal having the form of an insert which is held in position by a snap ring 241 in an axial passage 242 drilled in a bottom ringlike member 243. The passages 236 focus into the constriction 240. When the piston 212 is forced downwardly, it extends the piston extension 220 downwardly into the constriction 240 and limits flow therethrough. As a result of this, the mud flow through the tool 10 is modulated to form a signal indicative of the variable of interest.

The variables which can be tested by the present apparatus are substantially without limit. The primary requirement is that a transducer responsive to the variable be incorporated to form an electrical signal encoding the variable in signal length. One variable of interest is the deviation from the vertical angle, and a pendulum type device can be used to determine this. The output signal is converted into a pulse duration which is applied to the two-way valve operator 195, thereby forming a pressure pulse delivered to the piston 212 for its operation. Because the hydraulic oil flows in a closed loop from the valve 190 to the piston 212, the response is quite rapid. Rapid response is aided by an upstream accumulator which boosts flow above that provided by a pump alone.

Figure 2:
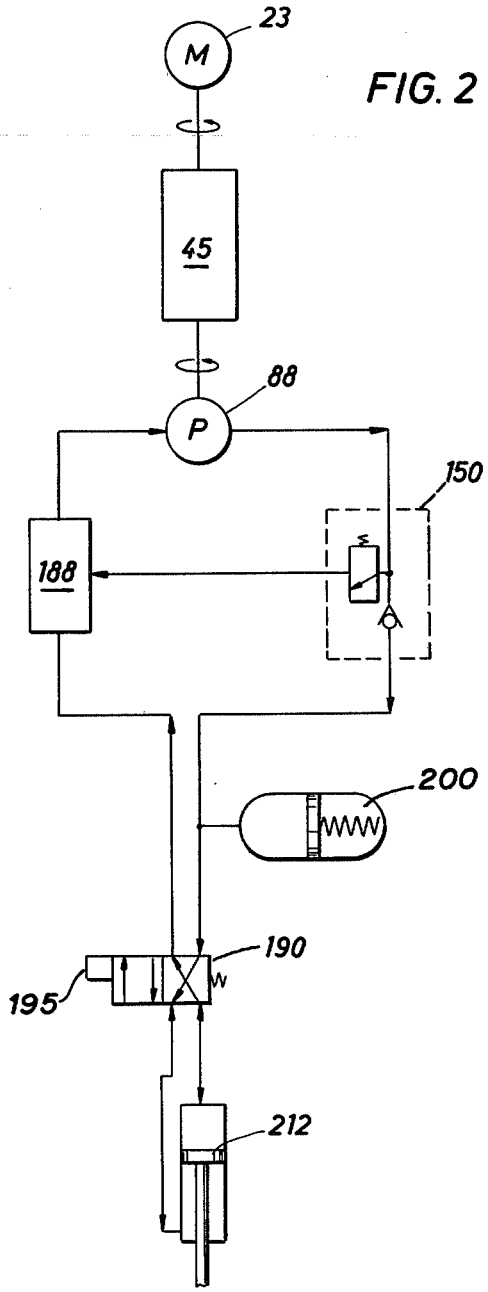
FIG. 2 is a hydraulic schematic showing how the device encodes the variation in a mud flow modulator system.

In operation, the device functions in the following manner. Mud is pumped through the device, and it rotates the plate 23 shown in FIG. 3A, thereby turning the shaft 45. The shaft 45 is connected with a pump 88 as shown in FIG. 2 of the drawings. The pump 88 pumps oil under pressure through an overflow or unloader valve 150. The valve 150 dumps excessive oil to reduce pressure back. Oil which is needed is not dumped. It is, accordingly, pumped through the valve 150 to the accumlator and then to the two-position, four-way valve 190. It will be appreciated that there is, in effect, an accumulator operating in the system as shown in the hydraulic schematic of FIG. 2 of the drawings. The valve 190 operates the piston 212 to modulate the mud flow at the bottom of the tool as shown in FIG. 3H. The return path is through the two-position, four-way valve 190 and back to the reservoir or sump shown symbolically in FIG. 2 of the drawings.

The foregoing is directed to the preferred embodiment, but the scope is determined by the claims which follow.

I claim:

1. Apparatus for use in a drill string to form a signal of downhole drilling information, comprising:

(a) an elongate outer body of tubular construction having an outer wall and which outer body terminates in upper and lower connective means for connection in a drill string;

(b) an inner body received inside of and enclosed within said outer body;

(c) means for positioning said inner body to define a mud flow annular space around said inner body on the interior of said outer body;

(d) motor means for intercepting the flow of mud through said annular space which motor means converts the mud flow into rotational torque;

(e) a shaft connected to said motor to be rotated thereby;

(f) an hydraulic pump connected to said shaft for pumping hydraulic fluid at an elevated pressure;

(g) a controllable valve means;

(h) a movable piston received in a cylinder;

(i) a constricted passage in said annular space located such that the mud flow through the annular space is directed through the constricted passage, and a plug movably actuated by said piston to vary the constiction on the mud flow with movement of said plug; and (j) an hydraulic circuit connected to said hydraulic pump utilizing hydraulic fluid flowing in hydraulic conduits through said controllable valve to said piston and cylinder for moving the piston to an altered position to modulate the flow of mud and thereby form an output signal dependent on the manipulation of said controllable valve means.

2. The apparatus of claim 1 wherein said hydraulic circuit further includes a dump valve which is connected to one side of the hydraulic pump, which side of the pump provides hydraulic fluid at elevated pressure.

3. The apparatus of claim 1 wherein said controllable valve means comprises a two-position valve, controllably switching in a controlled fashion to move said piston.

4. The apparatus of claim 1 wherein said piston and cylinder and said plug actuated thereby for varying the constriction on the mud flow is returned to a full open position whereby said plug produces a minimum constriction at said constricted passage, the apparatus including accumulator means and valve means for accumulating hydraulic fluid under pressure in said accumulator means and wherein said valve means is connected to said accumulator means for delivering hydraulic fluid pressure to operate said piston and cylinder to retract said plug to the maximum opening of said constricted passage.

5. The apparatus of claim 1 including an in-line accumulator means which comprises an elongate, hollow, closed chamber means having upper and lower ports therein to permit fluid flow through said accumulator means, a spring for compressing a movable plug in said chamber means wherein said plug is axially hollow to permit the inlet and outlet of said accumulator means to be communicated together and said accumulator means is connected in said hydraulic circuit.

6. The apparatus of claim 1 wherein said motor means incorporates a set of angled, mud flow driven means intercepting the mud flow in a fashion such that the mud flow rotates said means, and further including means for directing mud flow therefrom into said annular space.

7. The apparatus of claim 6 wherein said motor means includes a plate transverse of said inner body which has an opening means at the upper face to receive the mud flow thereagainst and includes at least one angled passage therethrough which opens out toward said annular space in said outer body; a shaft supporting said plate; bearing means for positioning said shaft for rotation; and seal means around said shaft to prevent mud from flowing along said shaft to said bearing means.

8. The apparatus of claim 7 further including a closed and sealed lubricating oil flow system adapted to deliver oil to said bearing means behind said seal means.

9. The apparatus of claim 1 wherein said shaft connects with a rotatable alternator means for generating electric power.

10. The apparatus of claim 9 wherein said controllable valve means includes a solenoid operator, and power for its operation is provided by said alternator means.

11. The apparatus of claim 1 wherein said outer body supports said inner body therein concentrically arranged to define said annular space through said outer body and including spacing ribs positioning said outer body about said inner body, and a bottom located, faired housing below said inner body which directs the mud flow toward said constricted passage below the end of said inner body.

12. The apparatus of claim 11 wherein said plug extends axially below said inner body into said constricted passage for selectively blocking mud flow through said passage.

13. The apparatus of claim 1 including a pressure accumulator means connected to impart pressure to said piston and cylinder in addition to the pressure from said hydraulic circuit to improve the speed of response of said piston and cylinder and thereby move said plug more rapidly.

14. The apparatus of claim 13 wherein said hydraulic circuit further includes an unloader valve which is connected to one side of said hydraulic pump which unloads fluid therefrom to reduce pressure in said hydraulic circuit below a specified level which diverted flow is directed into said accumulator means to increase the fluid pressure in said accumulator means and wherein the hydraulic fluid pressure in said accumulator means is greater than that required to operate said piston and cylinder arrangement to move said plug through a full stroke of its operation.

15. The apparatus of claim 14 including means for pressurizing said accumulator means, and wherein said unloader valve is selectively energized and de-energized in diverting hydraulic fluid from said hydraulic circuit into said accumulator means.

16. The apparatus of claim 1 including an internal lubricating system for lubricating said motor and said shaft which is sealed by a seal means and wherein said seal means includes a seal exposed to lubricating oil pressure on one side thereof and which is further exposed to drilling mud on the other side wherein the lubricating oil is maintained at a pressure in excess of the pressure of the drilling mud and further including therebelow an exposed, open chamber so that contaminants in the lubricating oil settle toward the bottom of that chamber and away from said seal means.

17. The apparatus of claim 16 wherein said shaft and said motor are protected by a first lubricating system, and said shaft and the hydraulic pump operated thereby are protected by a second lubricating system, and the first and second lubricating systems are separated by a seal means therebetween such that any impurities introduced into the second lubricating system must pass through the first seal means and the first lubricating system.

* * * * *